United States Patent [19]

Magiera

[11] 4,032,154

[45] June 28, 1977

[54] BOARD GAME APPARATUS

[75] Inventor: David L. Magiera, Hopkins, Minn.

[73] Assignee: Wicks & Nemer, P.A., Minneapolis, Minn.

[22] Filed: July 8, 1974

[21] Appl. No.: 486,607

[52] U.S. Cl. ..... 273/134 AT

[51] Int. Cl.[2] ..... A63F 3/00

[58] Field of Search ..... 273/134

[56] References Cited

UNITED STATES PATENTS

| | | | |
|---|---|---|---|
| 748,626 | 1/1904 | Magie | 273/134 AF |
| 2,976,044 | 3/1961 | Corpening | 273/134 AF |
| 3,058,747 | 10/1962 | Nemetsky et al. | 273/134 AF |
| 3,565,437 | 2/1971 | Mitchell | 273/134 AD |

FOREIGN PATENTS OR APPLICATIONS

| | | | |
|---|---|---|---|
| 1,134,147 | 11/1968 | United Kingdom | 273/134 B |

*Primary Examiner*—Delbert B. Lowe
*Attorney, Agent, or Firm*—Wicks & Nemer

[57] ABSTRACT

Game apparatus is disclosed having a board with marked spaces or areas constituting a path of progression about the board. The preferred embodiment of the game apparatus further includes a medium of payment, such as token money, a first set of cards indicating limits for at least one type of game points, a second set of cards adding and/or subtracting game points, and a third set of cards adding or subtracting from the balance of the monetary notes. Also in the preferred embodiment, a portion of the spaces of the game board path are designated for certain reward/penalty spaces, major game object spaces for directing the players to draw a card from the second set of cards adding or subtracting game points, minor game object spaces for directing a player to draw a card from the third set of cards adding and/or subtracting from the balance of monetary notes, and game completion squares. The preferred embodiment of the game apparatus further includes game markers for each individual player to move around the spaces on the board as determined by chance taking apparatus such as dice. In the preferred embodiment, the objective of the game is for a player to meet a first game object, obtaining game points within the limits set by a card from the first set of cards, and land on the game completion square while simultaneously meeting a second game object, maintaining a proper balance of monetary notes to meet expenses.

2 Claims, 6 Drawing Figures

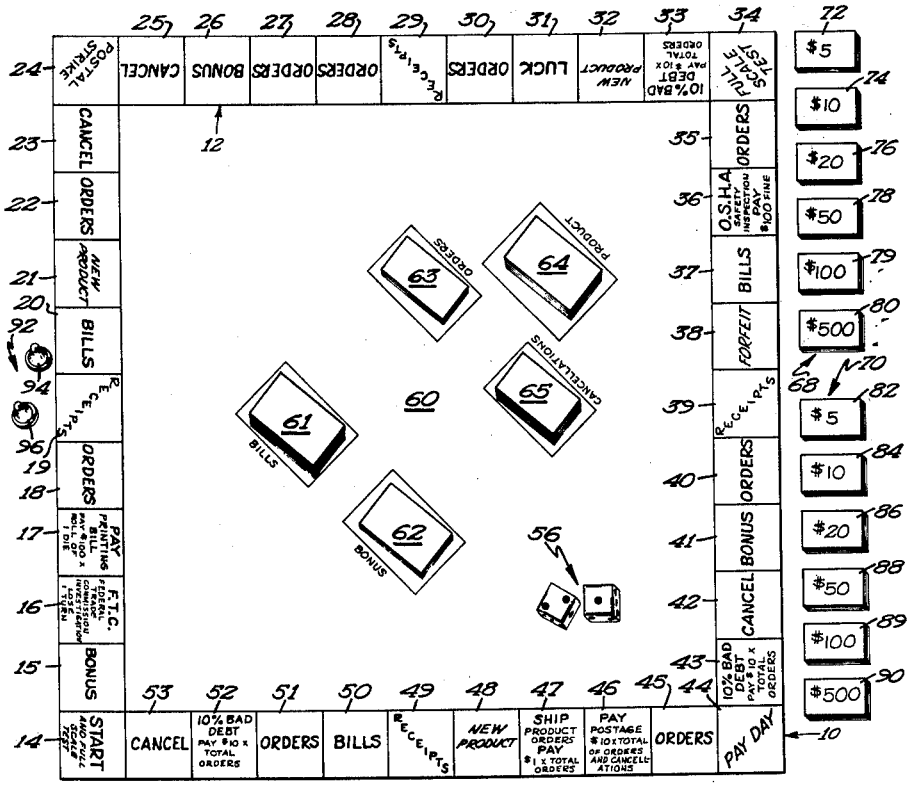

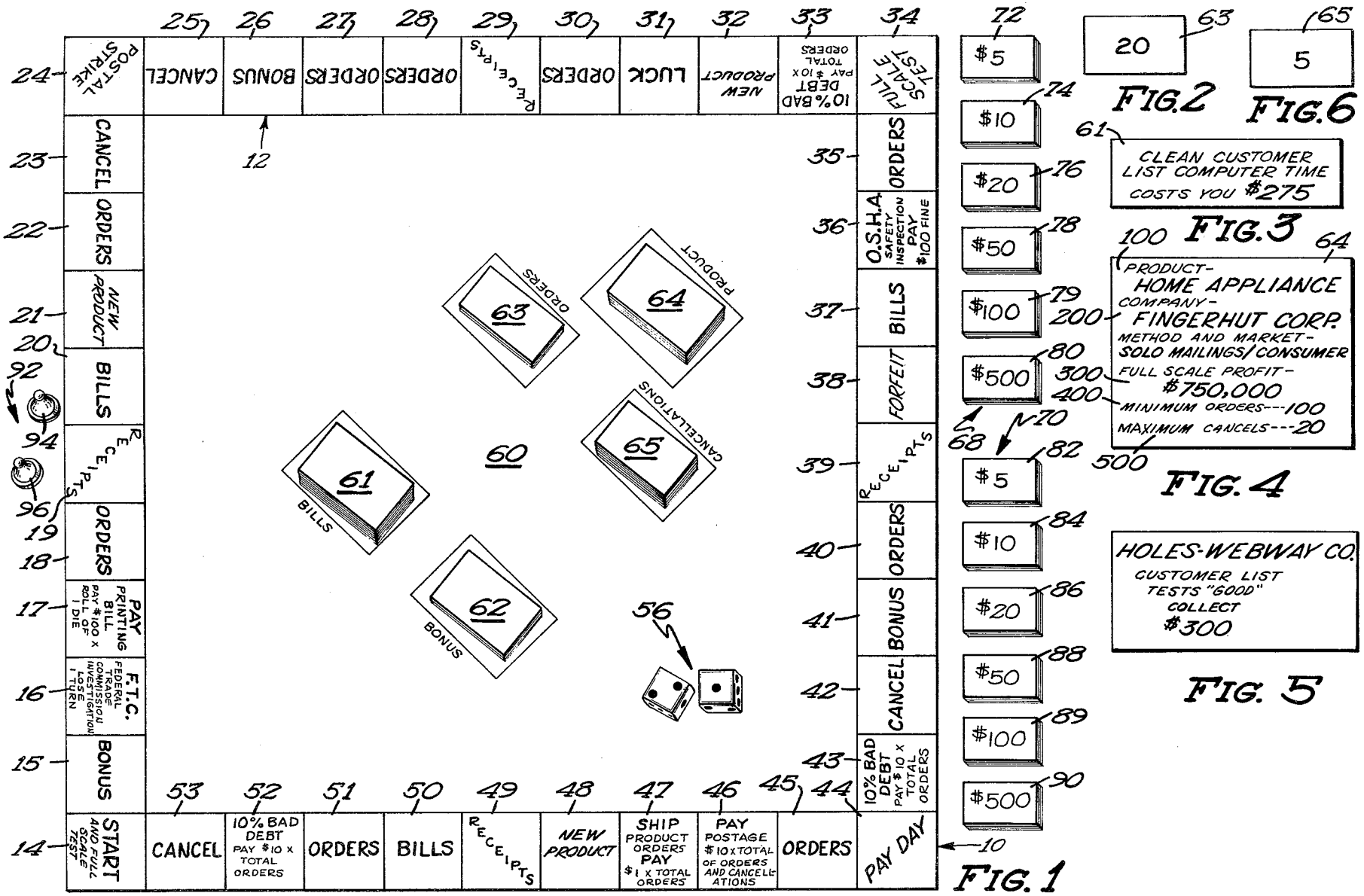
FIG. 1
FIG. 2
FIG. 3
FIG. 4
FIG. 5
FIG. 6
CLEAN CUSTOMER LIST COMPUTER TIME COSTS YOU $275
PRODUCT- HOME APPLIANCE
COMPANY- FINGERHUT CORP.
METHOD AND MARKET- SOLO MAILINGS/CONSUMER
FULL SCALE PROFIT- $750,000
MINIMUM ORDERS---100
MAXIMUM CANCELS---20
HOLES-WEBWAY CO.
CUSTOMER LIST TESTS "GOOD" COLLECT $300
START AND FULL SCALE TEST
PAY PRINTING BILL PAY $100 X ROLL OF 1 DIE
F.T.C. FEDERAL TRADE COMMISSION INVESTIGATION LOSE 1 TURN
POSTAL STRIKE
CANCEL
ORDERS
NEW PRODUCT
BILLS
RECEIPTS
BONUS
10% BAD DEBT PAY $10 X TOTAL ORDERS
PAY POSTAGE $10 X TOTAL ORDERS AND CANCELLATIONS
SHIP PRODUCT ORDERS PAY $1 X TOTAL ORDERS
O.S.H.A. SAFETY INSPECTION PAY $100 FINE
FORFEIT
FULL SCALE TEST
PAY DAY
PRODUCT
CANCELLATIONS

BOARD GAME APPARATUS

BACKGROUND

The present invention relates generally to a board game and more particularly, to a board game including chance.

With the increasing amounts of leisure time available to persons generally in modern society, an increasing need has been felt for amusement devices to occupy such leisure time. A selected class of such amusement devices has been generally favored as providing substantially nonrepetitive play, requiring logic and intelligent decision making during play, and generally maintaining a high degree of interest for an extended period of time. Board games are within this selective class.

The present invention provides such a board game generally simulating the activities of a mail-order business.

SUMMARY

A preferred embodiment of the present invention includes a game board with marked spaces and areas constituting a path of progression about the board. Also provided are a first set of cards indicating limits for at least one type of game points, a second set of cards for adding and subtracting game points, monetary tokens, and a third set of cards for adding and/or subtracting from the balance of monetary notes.

Game markers are further provided with one piece initially representing or being associated with each player. Dice are provided as a first chance taking apparatus determining the movement of each player's game marker along the progression of spaces on the board.

The player must land on a specific location while fulfilling two game objects. The first object is for a player to receive game points within the limits indicated by a card from the first set of cards, and the second game object is to maintain a sufficient token monetary balance to allow the player to meet his expenses during the course of play.

It is thus a primary object of the present invention to provide a novel board game apparatus.

It is further object of the present invention to provide such apparatus for allowing the play of a board game including chance.

It is a further object of the present invention to provide such apparatus for allowing the play of a board game generally simulating the activities of a mail-order business.

These and further objects and advantages of the present invention become clearer in light of the following detailed description of an illustrative embodiment of this invention described in connection with the drawings.

DESCRIPTION OF THE DRAWINGS

FIG. 1 shows a top plan view of a game board according to the present invention, including plane and perspective views of various of the remaining apparatus for play of the board game.

FIGS. 2, 3, 4, 5, and 6 represent cards for use during the play of the game board apparatus of FIG. 1.

DESCRIPTION

In FIG. 1, a game board 10 used in the board game apparatus of the present invention is shown. Game board 10 includes a plurality of marked spaces, locations, or areas constituting a path progression about board 10, which path is generally designated 12. In particular, path 12 includes location 14 to 53 arranged sequentially and continuously to form a border around the outer edge of board 10 and enclose a central portion 60. It will be obvious to those skilled in the art that the path need not be so arranged but may be any path in any arrangement about the board. A path arranged about the boarder of the board is deemed preferred, however. Within central portion 60 of board 10, first chance taking apparatus or dice 56 are shown. Also within central portion 60 of board 10 are stacks of cards in the form of cards 61 designated "BILLS" cards, cards 62 designated "BONUS" cards, cards 63 designated "ORDERS" cards, cards 64 designated "PRODUCT" cards, and cards 65 designated "CANCELLATIONS" cards. Cards 61 through 65 are arranged face down in the position indicated, and each set includes individually printed cards.

In the preferred embodiment, the legends on the faces of the "BILLS" cards 61 are:

- PAY HOLDEN PRINTING CO. (MPLS., MINN.) FOR PRINTING SERVICES $250
- PAY FOR INCREASED PAPER COSTS $220
- TEST NEW LIST PAY FOR LIST RENTAL $250
- RENEW MAILING PERMIT PAY $40
- PAY D. MAGIERA COMPANY (HOPKINS, MINN.) FOR CONSULTING SERVICES $125
- PAY FOR COPYRIGHTING SERVICES $150
- INCREASED IMPORT TARIFF COSTS YOU $100
- UPDATE COMPUTER BILLING SYSTEM PAY $125
- UNCLE SAM INCREASES POSTAGE RATES PAY $500
- DOLLAR DEVALUATION COSTS YOU $400
- CONVERT RECORDS TO MICROFILM PAY $250
- CLEAN CUSTOMER LIST COMPUTER TIME COSTS YOU $275
- LAYOUT AND DESIGN SERVICES COST YOU $125
- PAY PACKAGING COMPANY FOR SHIPPING CARTONS $300
- BUY COMPUTER TAPES PAY $50
- PAY ATTORNEY FEE $300
- TEST CO-OP MAILING. IT COSTS YOU $175
- PAY ASSOCIATION DUES $50
- CONVENTION SPACE COSTS YOU $250
- PRODUCT DEVELOPMENT COSTS YOU $300

A sample of the face of a BILLS card 61 is shown in FIG. 3.

The preferred legends on the faces of the "BONUS" cards 62 are:

- WALTER KARL,INC. (ARMONK, B.Y.) RENTS YOUR CUSTOMER LIST COLLECT $350
- RECEIVE A BONUS OF $450
- YOU MAY DRAW AN ORDER CARD
- LIST MANAGER RENTS YOUR CUSTOMER LIST YOU MAKE $300
- RECEIVE A BONUS OF $75
- ADVANCE TO NEAREST RECEIPT SPACE
- GO FORWARD 4 SPACES
- YOU WIN A TRADE NAME SUIT.
- COLLECT $200
- HOLES-WEBWAY CO. (ST. CLOUD, MINN.) CUSTOMER LIST TESTS "GOOD" COLLECT $300
- YOUR COMPETITORS MUST DRAW A CANCEL CARD

YOU MAY PICK NEW PRODUCT CARD IF YOUR TEST IS SUCCESSFUL
PROFIT ON STOCK COLLECT $225
NEW SUPPLIER CUTS PRODUCT COST. YOUR MAKE $275
SAVE THIS CARD. AVERT POSTAL STRIKE
COLLECTION AGENCY COLLECTS ON BAD DEBTS RECEIVE $300
ADVANCE TO FULL SCALE!
RECEIVE A BONUS OF $50
GO TO OFFICE AND DOUBLE SALARY COLLECT $200
RETURN ONE CANCEL CARD!
ADVANCE TO LUCK

A sample of the face of a BONUS card 62 is shown in FIG. 5.

The preferred legends on the ORDERS cards 63 are the integers 5, 10, 15, and 20, and a sample of the face of an ORDERS card 63 is shown in FIG. 2.

Similarly, the preferred legends on the CANCELLATIONS cards 65 are the integers 2, 3, 4, and 5, and a sample of the face of a CANCELLATIONS card 65 is shown in FIG. 6.

At two locations about the edge of board 10, two piles of money tokens, generally designated 68 and 70, are shown with one pile associated with each of the two players indicated as using the board game apparatus 10 of the present invention. Each of the players have sorted the tokens into individual piles by denominations such that money 68 includes piles 72, 74, 76, 78, 79, and 80 of denominations of $5, $10, $20, $50, $100, and $500. Further, pile 70 is similarly sorted into denominations of 82, 84, 86, 88, 89, and 90. While specific denominations are shown, it will be immediately realized to those skilled in the art that no limitations to the precise values given is intended. Fewer denominations or more denominations may be used.

Also shown in FIG. 1 are a plurality of individual playing pieces, generally designated 92, shown as situated adjacent to board 10. Pieces 92 include separate player pieces 94 and 96, which may be items specifically related to rules of the game, such as different home appliances, or other pieces which can be separately identified.

Each of the locations of FIG. 1 are divided into particular classes including: major game object locations giving instructions to draw a card from the stacks of cards adding or subtracting from a first type of game points, i.e. orders and cancellations; minor game object locations giving instructions to draw a card from the stacks of cards adding or subtracting from the monetary balance; reward/penalty locations having instructions thereon instructing the particular player who lands thereon which comprise such locations as "F.T.C.", "PAY PRINTING BILL", "RECEIPTS", "POSTAL STRIKE", "LUCK", "10% BAD DEBT", "O.S.H.A.", "FORFEIT", "PAY DAY" "PAY POSTAGE", AND "SHIP PRODUCT ORDERS"; first level game completion locations designated "NEW PRODUCT"; and major game object game completion locations designated "FULL SCALE TEST" and "START AND FULL SCALE TEST" whose functions shall be explained further hereinafter.

Therefore, the preferred embodiment of the minor game object locations are locations instructing a player to draw from the BONUS cards 62 including locations designated 15, 26, and 41, and locations instructing a player to draw from the BILLS cards 61 including locations designated 20, 37, and 50. Major game object locations are locations instructing a player to draw from the ORDERS cards 63 including locations designated 18, 22, 27, 28, 30, 35, 40, 45, and 51 and locations instructing a player to draw from the CANCELLATIONS cards 65 includes locations designated 23, 25, 42, and 53.

First level completion locations designated "NEW PRODUCT" are locations 21, 32, and 48.

Reward/penalty locations include: the F.T.C. location 16; the PAY PRINTING BILL location 17; the RECEIPTS locations including locations designated 19, 29, 39, and 49; the POSTAL STRIKE location 24; the "LUCK" location 31; the 10% BAD DEBT locations which include locations designated 33, 43, and 52; the PAY DAY location 44; the PAY POSTAGE location 46; and the SHIP PRODUCT ORDERS location 47.

The major game object game completion locations include location 34 designated FULL SCALE TEST, and the location 14 designated START AND FULL SCALE TEST.

FIG. 4 shows an example of a "PRODUCT-COMPANY" card generally designated 64. Each card contains the product allocation designated 100, a company allocation designated 200, a profit allocation designated 300, a minimum order allocation designated 400, and a maximum cancellation allocation designated 500. The product allocation 100 can be chosen from a set of products including, in the preferred embodiment, "HOME APPLIANCES", "HOME ENTERTAINMENT", "OFFICE SUPPLIES", and "CLUB MEMBERSHIP". The company allocation 200 can be any company that manufactures and/or sells the product or service indicated in the product allocation 100. For example, the company chosen for the product HOME APPLIANCE in FIG. 4 was "FINGERHUT CORPORATION" of Minnetonka, Minnesota. The full scale profit allocation 300 is associated with a certain monetary values such as $250,000; $500,000; and $750,000. The minimum order allocation 400 can be designated as an integer value such as 50, 75, and 100. The maximum cancellation allocation 500 is designated an integer value such as 12, 15, and 20. The purpose of allocations 100, 200, 300, 400, and 500 will be explained further hereinafter.

OPERATION

The objective of the game apparatus of the present invention is to allow the play of a board game where game markers representing individual players progress about a path on the board in a repetitive and cyclic manner depending upon a chance taking apparatus, in this case, the throw of dice 56. Each player begins with a given amount of token money 68, 70 in his procession and a PRODUCT-COMPANY card 64. Progression about the board allows various transactions to occur which can either increase or decrease the amount of token money in the possession of each player, the number of orders, and the number of cancellations. The objective of the game is for a player to satisfy two separate game objects and to land on a specific location on the path on the board. The first game object is to exceed or match the minimum order allocation 400 on a product card while remaining below or equal to the maximum cancellation allocation 500 on that product card. The second game object is to maintain a certain token monetary balance allowing the player to meet his receipts and expenses as dictated by instructions located on the BILLS cards 61 and BONUS cards 62 and located on the various reward/penalty locations located on path 12 of game board 10.

More specifically, the total amount of money, such as money 68 and 70 shown in FIG. 1, originally is in the possession of the Bank, i.e., a neutral repository unattached to any player. For convenience, one of the players may be selected as the representative of the Bank and handle all the transactions in the name of the Bank. When operating in this capacity, the player selected must function in a neutral capacity. The role of the Bank's representative may further be delegated to various of the players at various times of the game.

Each player is given an initial amount of money by the Bank. In the preferred embodiment, $1,475 is alloted each player, and this money is represented by the piles 68 and 70 shown in FIG. 1. It will be realized that while the game as indicated is played by two persons in the present description, no limitation to this number is intended. Since the game is competitive, the minimum number is two; however, the maximum number must be determined by the tastes of the various players.

Each player is also assigned a playing piece such as playing pieces 92 shown in FIG. 1. Each playing piece is then placed on an initial location 14 designated START AND FULL SCALE TEST, in the preferred embodiment. The game is begun with each player rolling dice 56 to determine the starting device. In the preferred embodiment the player obtaining the highest number on the dice begins play followed by the remaining players in clockwise order.

The first player, assumed for the purpose of this description to have been assigned playing piece 94, then begins play by rolling dice 56 and moving his playing piece 94 the number of squares indicated by the vertically facing dots on the dice, as conventional. For example, dice 56 shown in FIG. 1 have three vertically upraised dots, and thus playing piece 94 would be moved across locations 15 and 16 and come to rest upon location 17 designated PAY PRINTING BILL.

Since location 17 is a penalty location, the first player then rolls one die and pays $100 times that amount in token money as instructed at location 17 of game board 10.

The second player then rolls the dice in turn and moves the appropriate number of spaces or locations. Assume for the sake of description, that the number 6 appears on the dice 56. The second player then moves to location 20 and, as instructed, draws a card from the BILLS cards 61. Assume, for the sake of example, the second player draws the BILLS card shown in FIG. 3. The second player would then be required to pay $275 as instructed on the face of BILLS card 61.

Since it is assumed that only two players are using the game apparatus 10 of the present invention, a cycle of play has been completed and the first player to throw the dice to indicate the number of locations to be moved by his playing piece, does so again. The game continues in this manner will one player completes a full scale test as will be explained hereinafter.

It will now be realized that various other of the locations 14-53 may at times be landed upon by one or more of the playing pieces 92. For example, after traversing the path 12 once in the cyclic repetitive fashion, a playing piece will either land or pass location 14, designated START AND FULL SCALE TEST. In the preferred embodiment, the rules of the game apparatus of the present invention indicate that a player collects an amount of $100 from the Bank when a playing piece either lands or passes location 44, designated PAY DAY.

To win, a player must complete successful tests, full scale those tests, and acquire at least $1,000,000 in profit allocations. To complete a successful test, a player must meet a first game object by obtaining enough ORDERS cards 63 such that the values equal or exceed the minimum order allocation 400 and, at the same time, avoid obtaining the maximum cancellation allocation 500 in total value of those shown on the CANCELLATIONS cards 65. A full scale test is achieved after completing successful tests by landing on the FULL SCALE TEST location 34 or the START AND FULL SCALE TEST location 14. After full scaling, the player receives from the Bank a profit certificate in the amount shown in the full scale profit allocation 300 on the PRODUCT-COMPANY card for which a full scale marketing effort was made.

If a player acquires more cancellations than his PRODUCT-COMPANY card 64 allows, his test is a failure and he must return his PRODUCT-COMPANY card 64 to its appropriate stack, his ORDERS card 63 to its appropriate stack, and the CANCELLATIONS cards 65 to its appropriate stack. The player then draws the top PRODUCT-COMPANY card 64 and begins play again on his next turn.

However, in order to full scale a test, a player must also meet a second game object, i.e. maintaining a monetary balance. If a player runs out of token money, he may sell or auction ORDERS cards 53 at any time. The Bank will give $10 per order or they may be auctioned to the highest bidder among the players. If the player has no token money or ORDERS cards 53 to sell in order to pay an expense, he must declare bankruptcy. In so doing the player must return all his remaining cards to the bottom of the appropriate stacks. He then draws a new PRODUCT-COMPANY card 64 and starts play again on his next turn. The player receives $500 from the Bank in the form of a government grant. If a profit certificate is owned when a player goes bankrupt, it must be forfeited to the Bank. But the government grant is increased according to the value of the profit certificate. In the preferred embodiment, for a $250,000 profit certificate, the total grant would be $1,500; for a $500,000 profit certificate the total grant would be $2,000; and for a $750,000 profit certificate the total grant would be $2,500.

Whenever a player full scales a test, all players testing the same product, as indicated by the product allocation 100, return all of these cards to the bottom of the appropriate decks. The player who achieved a full scale draws the top card from the PRODUCT-COMPANY cards 64 and the remaining players draw in a clockwise order, and play resumes.

After having completed a successful test by meeting the two separate game objects, a player is not safe from overcancelling until he either lands on a full scale square such as FULL SCALE TEST location 34 or START AND FULL SCALE TEST location 14 or he freezes his test by landing on a NEW PRODUCT location 48, 21, or 32. If a player lands on a first level completion location entitled NEW PRODUCT, and has met the two separate game objects, the player immediately draws the top PRODUCT-COMPANY card 64 and starts a new test. The player places all his "ORDERS" cards 63 and all his CANCELLATIONS cards 65 aside until a player lands on a full scale square as previously disclosed. It should be noted a frozen test is not immune to a competitive full scale by another player. If an opposing player full scales for the same product, all frozen tests on the same product must be forfeited.

If a player lands on POSTAL STRIKE location 24 he must go to PAY DAY location 44, lose one turn, and does not collect salary as instructed on location 44. But he may pay $100 to the central portion 60 of game board 10 and retain his turn.

If a player rolls dice 56 such that the number of vertically facing dots on each die are identical, the player receives another turn. If on moving the indicated number of squares the player lands on POSTAL STRIKE location 24, the player does not receive another chance but must follow the instructions given on location 24.

With respect to the second object of the game, a player can receive money from the Bank when he lands on the following locations: RECEIPTS locations 19, 29, 39, or 49; PAY DAY locations 44; or the minor game object BONUS locations 15, 26, or 41 and is instructed from the BONUS card 62 drawn as instructed, to collect a sum of token money.

On the other hand, a player pays money to the Bank when he lands on the following locations: BILLS locations 20, 37, or 50 requiring the player to draw from the BILLS cards 61 and paying the token money sum indicated; PAY PRINTING BILL location 17; PAY POSTAGE DUES location 46; SHIP PRODUCT ORDERS location 47; 10% BAD DEBT locations 33, 43, or 52; or "O.S.H.A." location 36.

With respect to the first object of the game, a player may obtain ORDERS cards 63 by landing on a major game object ORDERS location such as 18, 22, 27, 28, 30, 35, 45, and 51. However, a player must place one order card in the central portion 60 when he lands on a "FORFEIT" location 38. These ORDER cards 63 are placed in the center of the board and go to the first player landing on either location 14 or 34 at anytime.

Further, a player receives a CANCELLATIONS card 65 when he lands on a "CANCELLATIONS" location such as 23, 25, 42, and 53. But, a player may discard a CANCELLATIONS card 65 when he lands on the LUCK location 31.

A player loses one turn if he lands on the "F.T.C." location 16.

Now that the basic teachings of the present invention have been explained, many extensions and variations will be obvious to one having ordinary skill in the art. For example, to change the length of time required to play the game, the winning requirements can be changed such as playing to the first full scale test completion or for requiring a larger or lesser amount of full scale profit certificates.

Additionally, it should be realized that the BILLS cards 61 and the BONUS cards 62 can be mixed together and the minor game object locations entitled BILLS and BONUS include instructions for the player to draw from the combined stack.

Also, ORDERS cards 63 and CANCELLATIONS cards 65 can be combined into a single stack and have appropriate instructions thereon giving the players specific orders and/or cancellations. The major game object locations entitled CANCELLATIONS and ORDERS can then be combined such that all such locations instruct the player to draw from the combined stack.

Furthermore, in the preferred embodiment, the game points are in the form of monetary tokens, cancellations, and orders, but any type of game point indicating means can be used as is well known in the art.

Similarly, to change the length of time required to play, the rules can be modified in that a full scale test is achieved after completing successful tests and by landing on or passing the FULL SCALE TEST location 34 or landing on the START AND FULL SCALE TEST location 14. Thus, the full scale test requirement would greatly be reduced such that full scaling completed tests will occur at a more frequent rate than that of the preferred embodiment.

Thus since the invention disclosed herein may be embodied in other specific forms without departing from the spirit or the general characteristics thereof, some of which forms have been indicated, the embodiments described herein are to be considered in all respects illustrative and not restrictive. The scope of the invention is indicated by the appended claims, rathe than by the foregoing description and all changes which come within the meaning and range of equivalency of the claims are intended to be embraced therein.

What is claimed is:

1. Game board apparatus comprising, in combination: first means indicating limits for at least one type of game points, with the game points consisting of orders and cancellations; secon means adding and/or subtracting game points in a random manner; monetary tokens; third means adding or subtracting from the balance of monetary notes in a random manner; a game board having locations arranged thereon forming a path, the locations including reward/penalty locations, major game object locations for directing the player to follow the instructions of the second means adding or subtracting game points, and minor game object locations for directing the player to follow the instructions of the third means adding or subtracting from the balance of monetary notes; game markers for movement around the locations on the board; and chance taking apparatus for determining the movement of the game markers around the locations on the board during play, wherein a player tries to meet two separate game objects, where the first game object is determined by the first means and the second game object is to maintain a minimum balance of monetary tokens.

2. The apparatus of claim 1 wherein the locations include a specific game completion location upon upon which the game marker must land while fulfilling the first and second game objects.

* * * * *